US005737790A

United States Patent [19]

Badger et al.

[11] Patent Number: 5,737,790

[45] Date of Patent: Apr. 14, 1998

[54] RINSING PROCEDURE FOR AUTOMATIC WASHING MACHINE

[75] Inventors: Gordon George Badger; Paul Stephen Hood, both of Auckland, New Zealand

[73] Assignee: Fisher & Paykel Limited, Auckland, New Zealand

[21] Appl. No.: 686,255

[22] Filed: Jul. 25, 1996

[30] Foreign Application Priority Data

Jul. 26, 1995 [NZ] New Zealand ..... 272651

[51] Int. Cl.[6] ..... D06F 33/02

[52] U.S. Cl. ..... 8/158; 8/159; 68/12.05; 68/12.12; 68/12.21

[58] Field of Search ..... 8/158, 159; 68/12.05, 68/12.12, 12.21

[56] References Cited

U.S. PATENT DOCUMENTS 4,303,406 12/1981 Ross ..... 68/12.05 X 5,167,722 12/1992 Pastryk et al. ..... 8/159 X 5,271,116 12/1993 Williams et al. ..... 68/12.05 X

FOREIGN PATENT DOCUMENTS

0394657A1 3/1990 European Pat. Off. .

0394657B1 3/1990 European Pat. Off. .

*Primary Examiner*—Philip R. Coe

*Attorney, Agent, or Firm*—Trexler, Bushnell, Giangiorgi & Blackstone, Ltd.

[57] ABSTRACT

A laundry washing machine in which water is conserved by replacing the conventional deep rinse by a series of spray rinses. Each spray rinse utilises a predetermined quantity of water which is sprayed directly at the clothes load while the load is rotated, thereby allowing the rinse water to pass straight through the clothes load, removing soil and/or detergent from the clothes on its way. The amount of water used in each spray rinse is determined from a first "sense rinse" cycle in which the volume of water required to totally saturate the clothes load is found. In each subsequent rinse, a proportion (preferably from about 50% to about 100%) of this value is used.

21 Claims, 2 Drawing Sheets

RINSING PROCEDURE FOR AUTOMATIC WASHING MACHINE

FIELD OF THE INVENTION

This invention relates to washing cycles and more particularly though not solely to washing and/or rinsing cycles in automatic laundry washing machines.

DESCRIPTION OF THE PRIOR ART

During the washing cycle of many existing top loading laundry washing machines a number of common steps are carried out. Once the laundry load to be washed is deposited in the washing machine's spin tub (within a stationary water container), the basic steps in the washing process often include an initial wash phase where the laundry load is substantially submerged in a water/detergent mixture and the submerged wash load is washed by the action of an agitator or pulsator within the spin tub. The washing liquid is then drained and the laundry load spun at high speed in order to further centrifugally extract washing liquid from the load. This wash/drain phase is usually followed by one or more rinsing phases to further extract remaining detergent from the laundry load.

The previously mentioned rinsing phases have customarily included "deep rinse" and/or "spray rinse" phases. During a "deep rinse" phase water is admitted to the spin tub (during which time the spin tub may be slowly rotated) to the same level used in the previously described wash phase and the laundry load is agitated in the fresh water before the water is drained and a further spin phase is carried out. In comparison, during a "spray rinse" phase the spin tub is rotated at a relatively high speed while water is sprayed onto the laundry load which is held against the base and walls of the spin tub by the rotation of the spin tub. The water is continuously drained so that the incoming water passes through the laundry load and out the drain, taking with it some of the detergent remaining in the laundry load.

The washing cycle is usually completed by a high speed spin in which a large proportion of the remaining water in the laundry load is centrifugally extracted.

Washing cycles including the combination of the previously described "deep rinse" and "spray rinse" phases have the disadvantage that they require large quantities of water, subsequently reducing the water efficiency of the laundry washing machine. Accordingly, front loading (or horizontal axis) washing machines, which do not require that the laundry load be substantially submerged but rather continuously pass the tumbling load through a bath of water, have historically obtained much better water efficiency statistics than their top loading counterparts.

Attempts have been made to improve the water efficiency of top loading washing machines by, for example, recirculating the wash water for later use during the rinsing phases. Water recirculation has the disadvantage that the amount of detergent, lint and soil subsequently removed from the laundry load is reduced. An example of a top loading laundry washing machine which employs both the aforementioned "spray rinse", "deep rinse" as well as water recirculation techniques to improve the water efficiency of the machine is disclosed in New Zealand Patent No. 236665 published on 26 May 1993 (equivalent to U.S. Pat. No. 5,167,722 issued on 1 Dec. 1992) to Whirlpool Corporation. European Patent Specification No. 394657 to Bosch Siemens Hausgerate published on 31 Oct. 1990 discloses a multiple rinse laundry washing machine in which the duration of each rinse cycle and the water level during each rinse cycle is determined from the immediately preceding rinse cycle in order to decrease the overall duration of the washing cycle. The object of the invention disclosed is therefore to reduce the time rather than the amount of water used during the washing cycle and accordingly the water efficiency of such a machine will not be improved.

BRIEF SUMMARY OF THE INVENTION

It is, therefore, an object of the present invention to provide a method of washing a load in a washing machine which goes at least some way towards overcoming the above disadvantages or which will at least provide the public with a useful choice.

Accordingly, in one aspect, the invention consists in a method of washing and rinsing a load in a washing liquid and detergent solution during a washing cycle of a laundry washing machine having a rotatable spin tub within a stationary water container, the walls of said spin tub having a number of holes therein to allow liquid flow between said spin tub and said water container, a valve means to control admission of washing liquid to said spin tub, draining means to control the removal of said washing liquid from said water container, control means including timing means to determine the duration of selected functions of said washing machine and washing liquid level determining means, said method comprising the steps of:

i) commencing a washing phase of said washing cycle in which said valve means admits washing liquid to said spin tub and said load is washed in said liquid and detergent solution, ii) operating said draining means to drain a substantial amount of said washing liquid and detergent from said water container, iii) commencing a washing liquid and detergent extraction phase of said washing cycle to centrifugally extract washing liquid and detergent from said load by rotating said spin tub at a first speed for a predetermined length of time to cause said washing liquid and detergent to pass from said load, through said holes in said spin tub walls and into said water container while said draining means is operated to remove said washing liquid and said detergent from said water container, iv) commencing a sensing rinse phase of Said washing cycle by initiating admission of washing liquid into said spin tub while starting said timing means and causing said draining means to prevent said washing liquid from being removed from said water container, v) completing said sensing rinse by ending said admission of washing liquid to said spin tub when said washing liquid level indicating means indicates that the level of washing liquid in said water container has reached a predetermined level and stopping said timing means, said timing means indicating a sensed time representative of a sensed volume of washing liquid admitted to said spin tub during said sensing rinse phase, vi) operating said draining means to cause extraction of washing liquid and detergent from said water container and commencing a further washing liquid and detergent extraction phase of said washing cycle by rotating said spin tub at a second speed to centrifugally extract washing liquid and detergent from said load, vii) commencing a further rinse phase by operating said washing liquid admission means to cause a predetermined fraction of said sensed volume of said washing liquid to be admitted to said spin tub, viii) rotating said spin tub at a third spin speed to centrifugally extract washing liquid and detergent from said load, and ix) repeating steps (vii) and (viii) a number of times until the end of said washing cycle is reached.

In a second aspect, the invention consists in a laundry washing machine having a rotatable spin tub within a stationary water container, the walls of said spin tub having a number of holes therein to allow liquid flow between said spin tub and said water container, a valve means to control admission of washing liquid to said spin tub, draining means to control the removal of said washing liquid from said water container, control means which control the operation of said machine which includes timing means to determine the duration of selected functions of said washing machine and washing liquid level determining means, said control means storing a program which causes the control means to:

i) commence a washing phase of said washing cycle in which said valve means admits washing liquid to said spin tub and said load is washed in said liquid and detergent solution, ii) operate said draining means to drain a substantial mount of said washing liquid and detergent from said water container, iii) commence a washing liquid and detergent extraction phase of said washing cycle to centrifugally extract washing liquid and detergent from said load by rotating said spin tub at a first speed for a predetermined length of time to cause said washing liquid and detergent to pass from said load, through said holes in said spin tub walls and into said water container while said draining means is operated to remove said washing liquid and said detergent from said water container, iv) commence a sensing rinse phase of said washing cycle by initiating admission of washing liquid into said spin tub while starting said timing means and causing said draining means to prevent said washing liquid from being removed from said water container, v) complete said sensing rinse by ending said admission of washing liquid to said spin tub when said washing liquid level indicating means indicates that the level of washing liquid in said water container has reached a predetermined level and stopping said timing means, said timing means indicating a sensed time representative of a sensed volume of washing liquid admitted to said spin tub during said sensing rinse phase, vi) operate said draining means to cause extraction of washing liquid and detergent from said water container and commencing a further washing liquid and detergent extraction phase of said washing cycle by rotating said spin tub at a second speed to centrifugally extract washing liquid and detergent from said load, vii) commence a further rinse phase by operating said washing liquid admission means to cause a predetermined fraction of said sensed volume of said washing liquid to be admitted to said spin tub, viii) rotate said spin tub at a third spin speed to centrifugally extract washing liquid and detergent from said load, and ix) commence further rinse and spin phases utilising a predetermined fraction of said sense volume of said washing fluid until the end of said washing cycle.

The invention consists in the foregoing and also envisages constructions of which the following gives examples.

BRIEF DESCRIPTION OF THE DRAWINGS

One preferred form of the present invention will now be described with reference to the accompanying drawings in which;

The invention consists in the foregoing and also envisages constructions of which the following gives examples only.

Figure 1:
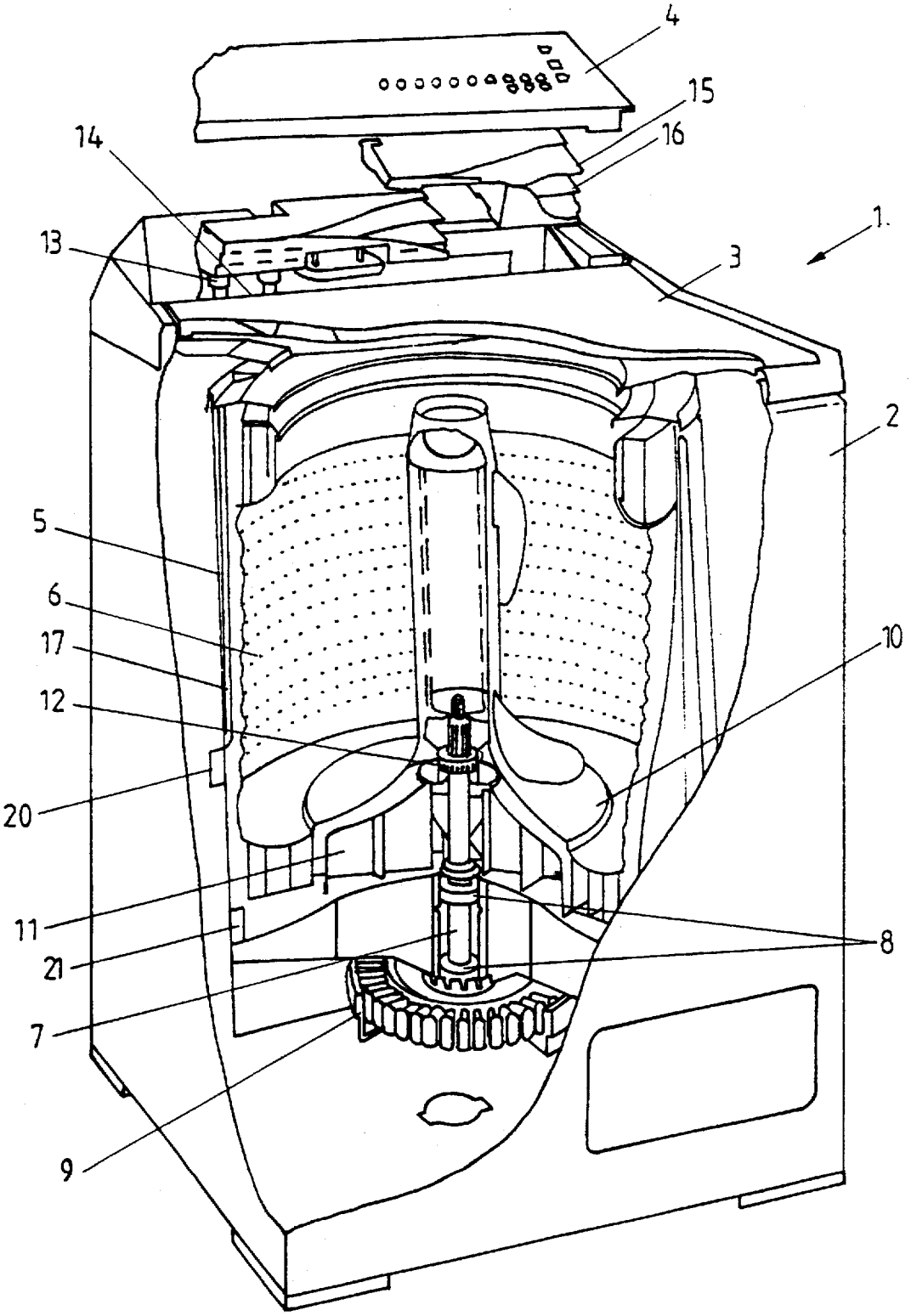
Figure 2:
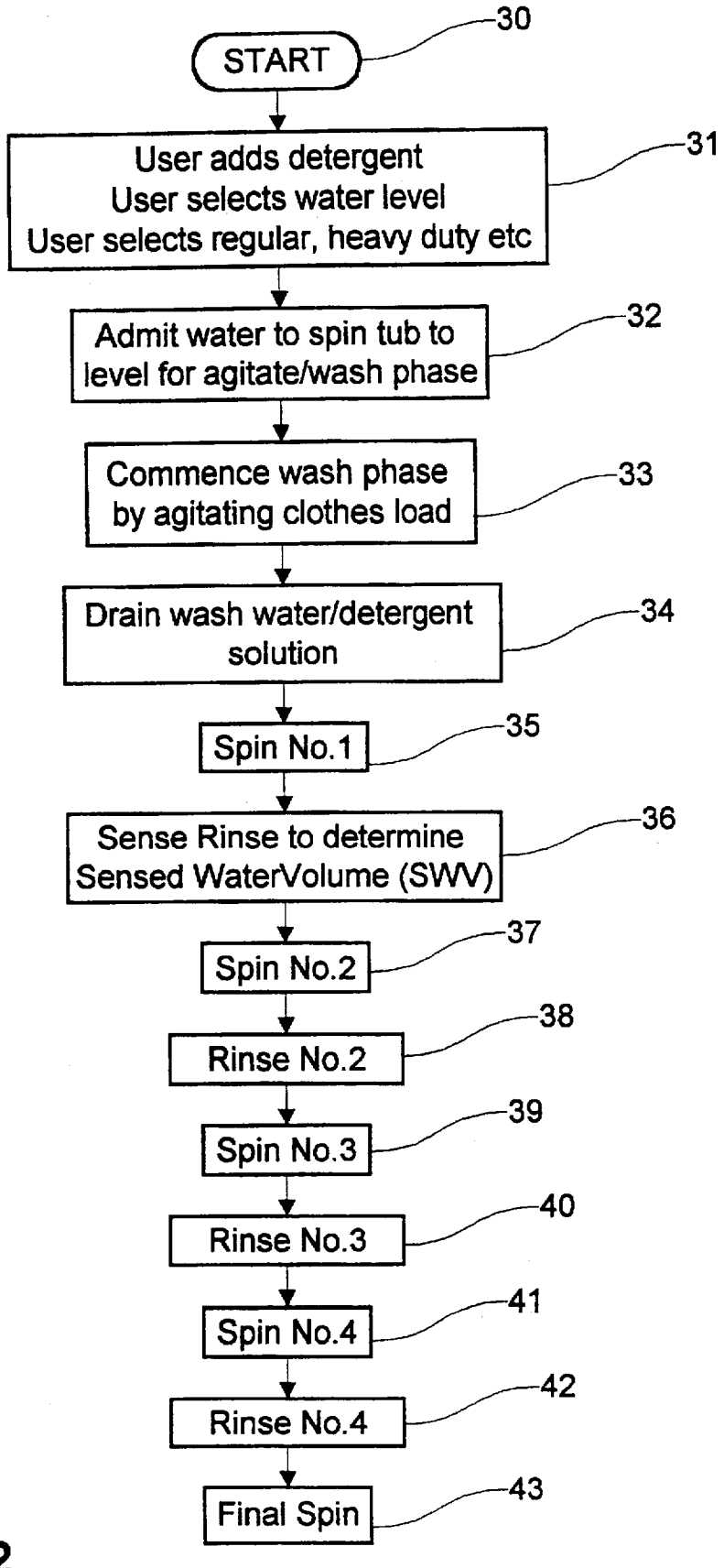

The invention will now be described with reference to the accompanying drawings in which:

FIG. 1 is a partially cut away perspective view of a laundry washing machine adapted to carry a washing cycle according to the method of the present invention, and FIG. 2 is a flow chart according to the present invention setting for operating the washing machine of FIG. 1 during a washing cycle.

DETAILED DESCRIPTION OF THE INVENTION

With reference to FIG. 1, a top-loading laundry washing machine 1 is shown having a cabinet 2, a hinged lid 3 and a control panel 4 with a series of buttons to allow user input to various parameters controlling the washing cycle of the machine 1. Hot and cold water valves 13 and 14 (which are preferably proportional valves) are connected to hot and cold water taps (not shown) allow water to enter the machine through a spray nozzle (not shown) which is positioned near the upper rim of spin tub 6 to direct water in a defined pattern within the spin tub. A stationary water container 5 is suspended within cabinet 2 from an upper part of the cabinet by suspension rods (not shown). Within the stationary water container 5, a rotatable spin tub 6 is positioned coaxially with water container 5, with a shaft 7 passing through the base of spin tub 6. Spin tub 6 is axially slidable on shaft 7 while, within the base of water container 5, a single pair of sealed bearings 8 are provided in which the shaft turns. The bearings 8 are protected from the washing liquid by a lip seal mounted above them to prevent washing liquid contacting the bearings.

The spin tub is adapted to receive a load of laundry for washing and is provided with a number of holes in its walls to allow water to pass from the spin tub to the water container 5. The lower end of shaft 7 is connected directly to the rotor of an electric motor which is preferably an Electronically Commutated Motor (ECM) of an "inside-out" design (the rotor being external to the stator) with the stator fixed to the base of water container 5. The upper splined end of shaft 7 is fixed within the base of an agitator 10 so that the agitator will always rotate with the motor 9 and shaft 7. The washing machine 1 is supplied with power by through a standard mains voltage supply cord (not shown) connected to a mains voltage supply. A drain pump (not shown) is provided to discharge water held in the water container at various stages during the washing cycle.

Within the base of spin tub 6 are a number of downwardly open air filled spaces 11 which, when water is admitted through valves 13 and/or 14 to the water container 5, provide an upwardly directed buoyancy force to the spin tub 6. When the water container is substantially empty of water, the spin tub and shaft 7 are connected together for movement by the motor 9 due to a dog clutch 12. When the upwardly directed buoyancy force is sufficient to overcome the downwardly directed weight force of the spin tub and clothes load, the spin tub will float upwardly on the shaft 7, disconnecting the oppositely opposed teeth of dog clutch 12 (one set of teeth on the shaft and one set of teeth in the base of spin tub 6) so that the spin tub will not rotate with the agitator. Thus, when a washing phase of a laundry cycle is being carried out and the clothes load are submerged, the agitator is oscillated back and forth independently of the spin tub to wash the clothes. During a spin phase of the washing cycle, the water container will be substantially empty of water and, accordingly, the agitator and spin tub will be rotated together at a high speed.

A controller, for example programmed controller or microprocessor 15 is provided to control the operation of the washing machine in accordance with the method of the present invention. The controller 15 has inputs connected to various sensors such as a water level sensor 16 comprising, for example, a pressure transducer receiving input of water level from tube 17 having its lower end connected to an open bottomed pressure chamber moulded in the plastic water container 5. User inputs of washing parameters such as water level, wash type selection (for example regular, heavy duty or delicate) are also supplied to controller 15 which executes a computer software program stored in memory associated with the controller and in turn supplies outputs to control various functions of the washing machine, such as opening and closing water valves 13 and/or 14, operating the drain pump, supplying commutation voltages to the stator windings of motor 9 to cause the rotor to operate in a predetermined pattern (for example, agitate or spin) and illuminating light emitting diodes (LED's) on control panel 4 to alert the user of the machine to the washing cycle selected and the progress of the washing cycle.

With reference now to FIG. 2, a flow chart is shown which illustrates the steps carried out by the washing machine 1 during a washing cycle in response to the execution of computer software by controller 15.

In use, the washing machine 1 is turned on by a user, initiating the process set out in FIG. 2 starting at block 30. The user loads the spin tub with the clothes load to be washed, adds an amount of detergent to the spin tub and then supplies information to the controller 15 in block 31, such as the water level required to wash the clothes load and the wash cycle required (for example, regular or heavy duty), water temperature and initiates the wash cycle by pressing a start button on control panel 4. Controller 15 then admits water to the spin tub at block 32 by operating valves 13 and/or 14 in appropriate proportions so that the water being directed at the clothes load by the spray nozzle is substantially at the temperature set by the user.

The water level within the water container is monitored until the desired water level is achieved at which time the water inlet valves 13 and/or 14 are closed and motor 9 is supplied with a commutation pattern to oscillate the agitator to wash the clothes load at block 33. The agitation pattern is designed to cause the agitator velocity to follow a predetermined velocity profile through each agitation "stroke", the magnitude and duration of which is dependent on the type of cycle selected (for example, heavy duty or regular) and periodically reversed to change the direction of rotation of agitator 10. The length of the washing/agitation phase may be, for example 12 minutes for a regular cycle and 15 minutes for a heavy duty cycle.

At the end of the wash/agitate phase, the drain pump is operated at block 34 to discharge the water/detergent/soil mixture (washing liquid) from water container 5. When nearly all of the washing fluid within water container 5 has been drained, as signalled by water level sensor 16 detecting that the water level has fallen below the lowest level of pressure chamber 20. After a period of time, for example 8 seconds, to allow the water below the pressure chamber's lower level to be drained, the motor is operated at block 35 to rotate the spin tub and agitator at a high speed to centrifugally extract a further amount of washing liquid from the clothes load. This first spin may, for example, be a short spin of about 2 minutes duration at a rotational velocity of, for example, 200 revolutions per minute (RPM).

At this point in the washing cycle, a number of rinses are carried out during which the spin tub is rotated at a speed of, for example 50 RPM, the water inlet valves are opened and the drain pump operated to extract washing liquid passing through the clothes load. The rinses are interspersed with further spin phases in order to further extract washing liquid from the clothes load. The exact number of rinse phases may be user selectable, the following description being one preferred example only.

The first rinse (or so called "sense rinse") is carried out at block 36 and involves admitting water to the spin tub (preferably directed at the clothes load which, after a spin phase will be distributed in a substantially triangular in cross-section region between the spin tub wall and base) while slowly rotating the spin tub and agitator so that all of the clothes load is wetted. Water is continually added to the clothes load until the water level sensor 16 first detects the water level.

The volume of water admitted to the spin tub during the sense rinse is ascertained by the controller 15. As the volume flow rate can be assumed constant, the volume admitted to the spin tub 6 can be represented by the length of time that the water valves were held open by the controller. This period may be monitored by a timer within controller 15 throughout the execution of the software program and the result (the Sensed Time or ST which represents the Sensed Water Volume or SWV) stored by the controller as a variable for later use by the software. The SWV is a value which may be considered as the sum of the volume of water required to completely saturate the present clothes load plus a volume of water which the clothes load lies in. It should be noted that the value of SWV will be dependent on the size of the clothes load being washed as some of the water will be absorbed by and held within the clothes load. Therefore the actual amount of water required to totally saturate the clothes load is a fraction of SWV. At the conclusion of the sense rinse a second spin phase is initiated at block 37 at, for example, 600 RPM for a duration of, for example, 2 minutes.

A second rinse phase is commenced at block 38 with the spin tub and agitator being rotated together at a speed of, for example, 50 RPM. Water valves 13 and/or 14 are opened to allow an amount of water to de directed at the clothes load, dependent on the sensed water volume (SWV). The volume of water used in this second rinse will be a fraction of the value of SWV (for example, 50% of SWV, 75% of SWV, 100% of SWV or any fraction from 50% to 100%) and this value could be set by the user. In order to supply the selected fraction of SWV to the clothes load within spin tub 6, controller 15 may, for example, time the admission of water to the spin tub and close valves 13 and/or 14 when the timer reaches the determined time (for example, 75% of ST). When the second rinse phase has been completed, a third spin phase is initiated at, for example, 600 RPM for a period of, for example, 2 minutes.

A third rinse phase is then carried out at block 40 using a water volume also dependent on the value of SWV. The volume used in the third rinse could be the same as for the second rinse, however, a different fraction of SWV (or, in reality a fraction of the sensed time ST) could alternatively be used. At block 40, a fourth spin phase is carried out at a spin speed of, for example, 1000 RPM for a duration of, for example, 2 minutes. A fourth me phase is conducted at block 42 using a fraction of the water volume determined in block 36. Again the fraction could, for example, be 75% of SWV (or the duration of the sense rinse could be 75% of the sensed time ST) or any other fraction.

The washing cycle is concluded by a final spin at block 43 at a spin speed of, for example, 1000 RPM for a duration of, for example, 6 minutes. At the end of the final spin, the clothes load will be free of much of the water added during the washing cycle and in a reasonable state of dryness, ready to be dried.

Alternatively, rather than a fixed member of rinse and spin phases being carried out after the sense rinse at block 36, the washing machine could be provided with a washing liquid quality sensor 21 (such as a turbidity sensor or a resistivity sensor) transmitting washing fluid quality information to controller 15. The washing cycle could end when sufficient rinse and spin phases have been carried out that the washing liquid quality sensor determines that the washing liquid quality has reached a predetermined quality (sufficient soil and detergent having been removed from the clothes load and washing liquid). In this case, a final high speed spin would be carried out after the water quality was determined to be acceptable.

The present invention, by doing away with a conventional "deep rinse" phase in which the clothes load is submerged in a large quantity of fresh water in order to remove detergent, results in lower water consumption by the washing machine. In addition, the "sense rinse" process determines the minimum quantity of water which is required to totally wet the clothes load, so that water is not wasted during rinsing, thereby improving the efficiency of the machine at rinsing the clothes load.

We claim:

1. A method of washing and rinsing a load in a washing liquid and detergent solution during a washing cycle of a laundry washing machine having a rotatable spin tub within a stationary water container, the walls of said spin tub having a number of holes therein to allow liquid flow between said spin tub and said water container, a valve means to control admission of washing liquid to said spin tub, draining means to control the removal of said washing liquid from said water container, control means including timing means to determine the duration of selected functions of said washing machine and washing liquid level determining means, said method comprising the steps of:

i) commencing a washing phase of said washing cycle in which said valve means admits washing liquid to said spin tub and said load is washed in said liquid and detergent solution, ii) operating said draining means to drain a substantial amount of said washing liquid and detergent from said water container, iii) commencing a washing liquid and detergent extraction phase of said washing cycle to centrifugally extract washing liquid and detergent from said load by rotating said spin tub at a first speed for a predetermined length of time to cause said washing liquid and detergent to pass from said load, through said holes in said spin tub walls and into said water container while said draining means is operated to remove said washing liquid and said detergent from said water container, iv) commencing a sensing rinse phase of said washing cycle by initiating admission of washing liquid into said spin tub while starting said timing means and causing said draining means to prevent said washing liquid from being removed from said water container, v) completing said sensing rinse by ending said admission of washing liquid to said spin tub when said washing liquid level indicating means indicates that the level of washing liquid in said water container has reached a predetermined level and stopping said timing means, said timing means indicating a sensed time representative of a sensed volume of washing liquid admitted to said spin tub during said sensing rinse phase, vi) operating said draining means to cause extraction of washing liquid and detergent from said water container and commencing a further washing liquid and detergent extraction phase of said washing cycle by rotating said spin tub at a second speed to centrifugally extract washing liquid and detergent from said load, vii) commencing a further rinse phase by operating said washing liquid admission means to cause a predetermined fraction of said sensed volume of said washing liquid to be admitted to said spin tub, vii) rotating said spin tub at a third spin speed to centrifugally extract washing liquid and detergent from said load, and ix) repeating steps (vii) and (viii) a number of times until the end of said washing cycle is reached.

2. A method of washing and rinsing a load as claimed in claim 1 wherein said washing liquid level determining means has a lower level sensing limit, offset a predetermined distance from the base of said water container and said step of completing said sensing rinse occurs when the level of said washing liquid reaches said lower level sensing limit.

3. A method of washing and rinsing a load as claimed in claim 1 or claim 2 wherein said step of commencing a sensing rinse and each step of commencing a further rinse phase include the step of rotating said spin tub at a fourth spin speed while washing liquid is admitted to said spin tub to allow said washing liquid to be distributed through said load.

4. A method of washing and rinsing a load as claimed in claim 1 or claim 2 wherein said step of commencing a sensing rinse and each step of commencing a further rinse phase include the step of said washing liquid admission means controlling the direction and/or the pressure of said washing liquid entering said spin tub to ensure said washing liquid is distributed through said load.

5. A method of washing and rinsing a load as claimed in claim 1 or claim 2 wherein said step of commencing a further rinse phase includes the steps of:

a) operating said valve means to allow washing liquid to enter said spin tub, b) starting said timer, and c) operating said valve means to stop admission of washing liquid to said spin tub when said timer reaches a predetermined fraction of said sense rinse time.

6. A method of washing and rinsing a load as claimed in claim 5 wherein said predetermined fraction of said sense rinse time is between about 50% and about 100%.

7. A method of washing and rinsing a load as claimed in claims 1 or claim 2 wherein said step of operating said draining means to cause extraction of washing fluid includes the step of starting said timer and commencing the step of rotating said spin tub at a high speed when said timer reaches a predetermined time.

8. A method of washing and rinsing a load as claimed in claim 1 or claim 2 wherein said second spin speed is greater than said first spin speed.

9. A method of washing and rinsing a load as claimed in claim 1 or claim 2 wherein said washing cycle ends when a predetermined number of further rinse phases have been completed.

10. A method of washing and rinsing a load as claimed in claim 1 or claim 2 wherein said washing machine includes washing fluid quality sensing means and said washing cycle ends when said washing fluid quality sensing means determine that the quality of said washing fluid has improved to a predetermined acceptable quality.

11. A laundry washing machine having a rotatable spin tub within a stationary water container, the walls of said spin tub having a number of holes therein to allow liquid flow between said spin tub and said water container, a valve means to control admission of washing liquid to said spin tub, draining means to control the removal of said washing liquid from said water container, control means which control the operation of said machine which includes timing means to determine the duration of selected functions of said washing machine and washing liquid level determining means, said control means storing a program which causes the control means to:

i) commence a washing phase of said washing cycle in which said valve means admits washing liquid to said spin tub and said load is washed in said liquid and detergent solution, ii) operate said draining means to drain a substantial amount of said washing liquid and detergent from said water container, iii) commence a washing liquid and detergent extraction phase of said washing cycle to centrifugally extract washing liquid and detergent from said load by rotating said spin tub at a first speed for a predetermined length of time to cause said washing liquid and detergent to pass from said load, through said holes in said spin tub walls and into said water container while said draining means is operated to remove said washing liquid and said detergent from said water container, iv) commence a sensing rinse phase of said washing cycle by initiating admission of washing liquid into said spin tub while starting said timing means and causing said draining means to prevent said washing liquid from being removed from said water container, v) complete said sensing rinse by ending said admission of washing liquid to said spin tub when said washing liquid level indicating means indicates that the level of washing liquid in said water container has reached a predetermined level and stopping said timing means, said timing means indicating a sensed time representative of a sensed volume of washing liquid admitted to said spin tub during said sensing rinse phase, vi) operate said draining means to cause extraction of washing liquid and detergent from said water container and commencing a further washing liquid and detergent extraction phase of said washing cycle by rotating said spin tub at a second speed to centrifugally extract washing liquid and detergent from said load, vii) commence a further rinse phase by operating said washing liquid admission means to cause a predetermined fraction of said sensed volume of said washing liquid to be admitted to said spin tub, viii) rotate said spin tub at a third spin speed to centrifugally extract washing liquid and detergent from said load, and ix) commence further rinse and spin phases utilising a predetermined fraction of said sense volume of said washing fluid until the end of said washing cycle.

12. A laundry washing machine as claimed in claim 11 wherein said washing liquid level determining meaning has a lower level sensing limit, offset a predetermined distance from the base of said water container and said step of completing said sensing rinse occurs when the level of said washing liquid reaches said lower level sensing limit.

13. A laundry washing machine as claimed in claim 11 or claim 12 wherein said washing liquid level determining means has a lower level sensing limit, offset a predetermined distance from the base of said water container and said step of completing said sensing rinse occurs when the level of said washing liquid reaches said lower level sensing limit.

14. A laundry washing machine as claimed in claim 11 or claim 12 wherein said step of commencing a sensing rinse and each step of commencing a further rinse phase include the step of rotating said spin tub at a fourth spin speed while washing liquid is admitted to said spin tub to allow said washing liquid to be distributed through said load.

15. A laundry washing machine as claimed in claim 11 or claim 12 wherein said step of commencing a sensing rinse and each step of commencing a further rinse phase include the step of said washing liquid admission means controlling the direction and/or the pressure of said washing liquid entering said spin tub to ensure said washing liquid is distributed through said load.

16. A laundry washing machine as claimed in claim 11 or claim 12 wherein said step of commencing a further rinse phase includes the steps of:

a) operating said valve means to allow washing liquid to enter said spin tub, b) starting said timer, and c) operating said valve means to stop admission of washing liquid to said spin tub when said timer reaches a predetermined fraction of said sense rinse time.

17. A laundry washing machine as claimed in claim 16 wherein said predetermined fraction of said sense rinse time is between about 50% and about 100%.

18. A laundry washing machine as claimed in claim 11 or claim 12 wherein said step of operating said draining means to cause extraction of washing fluid includes the step of starting said timer and commencing the step of rotating said spin tub at a high speed when said timer reaches a predetermined time.

19. A laundry washing machine as claimed in claim 11 or claim 12 wherein said second spin speed is greater than said first spin speed.

20. A laundry washing machine as claimed in claim 11 or claim 12 wherein said washing cycle ends when a predetermined number of further rinse phases have been completed.

21. A laundry washing machine as claimed in claim 11 or claim 12 wherein said washing machine includes washing fluid quality sensing means and said washing cycle ends when said washing fluid quality sensing means determine that the quality of said washing fluid has improved to a predetermined acceptable quality.

* * * * *